United States Patent [19]

Reynolds

[11] 4,028,993

[45] June 14, 1977

[54] CYCLE FIRING RATE REDUCING ASSEMBLY FOR AUTOMATIC WEAPONS

[75] Inventor: George L. Reynolds, Cambridge, Ill.

[73] Assignee: The United States of America as represented by the Secretary of the Army, Washington, D.C.

[22] Filed: Feb. 23, 1976

[21] Appl. No.: 660,191

[52] U.S. Cl. ..... 89/130
[51] Int. Cl.[2] ..... F41D 11/12
[58] Field of Search ..... 89/27 G, 125, 129 R, 89/130

[56] References Cited

UNITED STATES PATENTS 1,063,882 6/1913 Jones ..... 89/27 G

*Primary Examiner*—Stephen C. Bentley
*Attorney, Agent, or Firm*—Nathan Edelberg; Harold H. Card, Jr.; Robert O. Richardson

[57] ABSTRACT

Methods and apparatus for reducing the cyclic firing rate of automatic weapons by providing a rate reducing assembly which transmits a portion of the linear recoil and counterrecoil forces of the weapon bolt carrier through a cam follower to rotate a receiver carried inertia drum having a helically curved cam groove.

6 Claims, 4 Drawing Figures

CYCLE FIRING RATE REDUCING ASSEMBLY FOR AUTOMATIC WEAPONS

GOVERNMENT RIGHTS

The invention described herein may be manufactured and/or used by or for the Government for governmental purposes without the payment of any royalty thereon.

BACKGROUND OF THE INVENTION

The rate of cyclic firing of automatic weapons has been increased considerably over the years, yet increased firing rates have attendant problems not found in other slower firing rate types of weapons. For example, in some applications, hit probability is considerably reduced as is projectile dispersion control. Ammunition conservation is also a problem as is barrel life.

SUMMARY OF THE INVENTION

These and other problems, disadvantages, and difficulties of the prior art are substantially overcome by utilizing the present invention which comprises a rate-reducing assembly adapted for use to control the cyclic firing rate of automatic weapons 2 and includes a housing 22, recoil spring means 24 in the housing bottomed at one end against the bolt carrier 16 of the weapon, recoil buffer means 28 in the housing, and a rotatable inertia drum 32 in the housing having a helically curved cam groove 14 in which rides a cam follower or roller 48 carried by the bolt carrier during recoil and counter recoil movement of the bolt carrier. The movements of the cam follower during recoil and counterrecoil movement of the bolt carrier in the cam groove rotates the drum sequentially to transmit recoil and counterrecoil forces energies to the drum, thereby temporarily storing a portion of these energies to temporarily reduce the velocity of the bolt carrier and, thus, the cyclic firing rate of the weapon.

DESCRIPTION OF A PREFERRED EMBODIMENT

Figure 1:
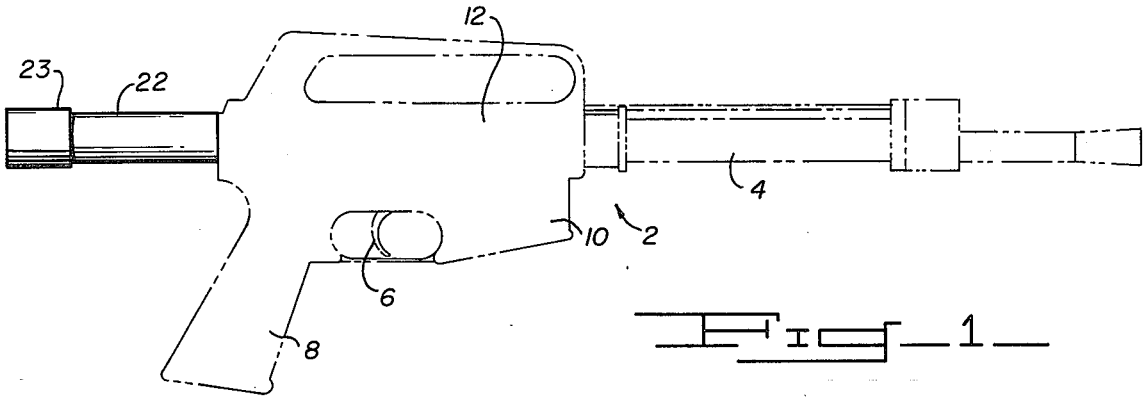
FIG. 1 is an embodiment of an automatic rifle shown in phantom incorporating the preferred embodiment of the present invention shown in full lines.
Figure 2:
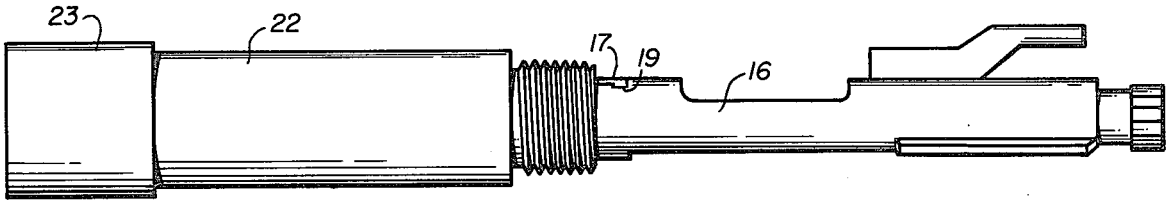
FIG. 2 illustrates in side view the connection between the rifle and the rate reducing assembly of the present invention.
Figure 4:
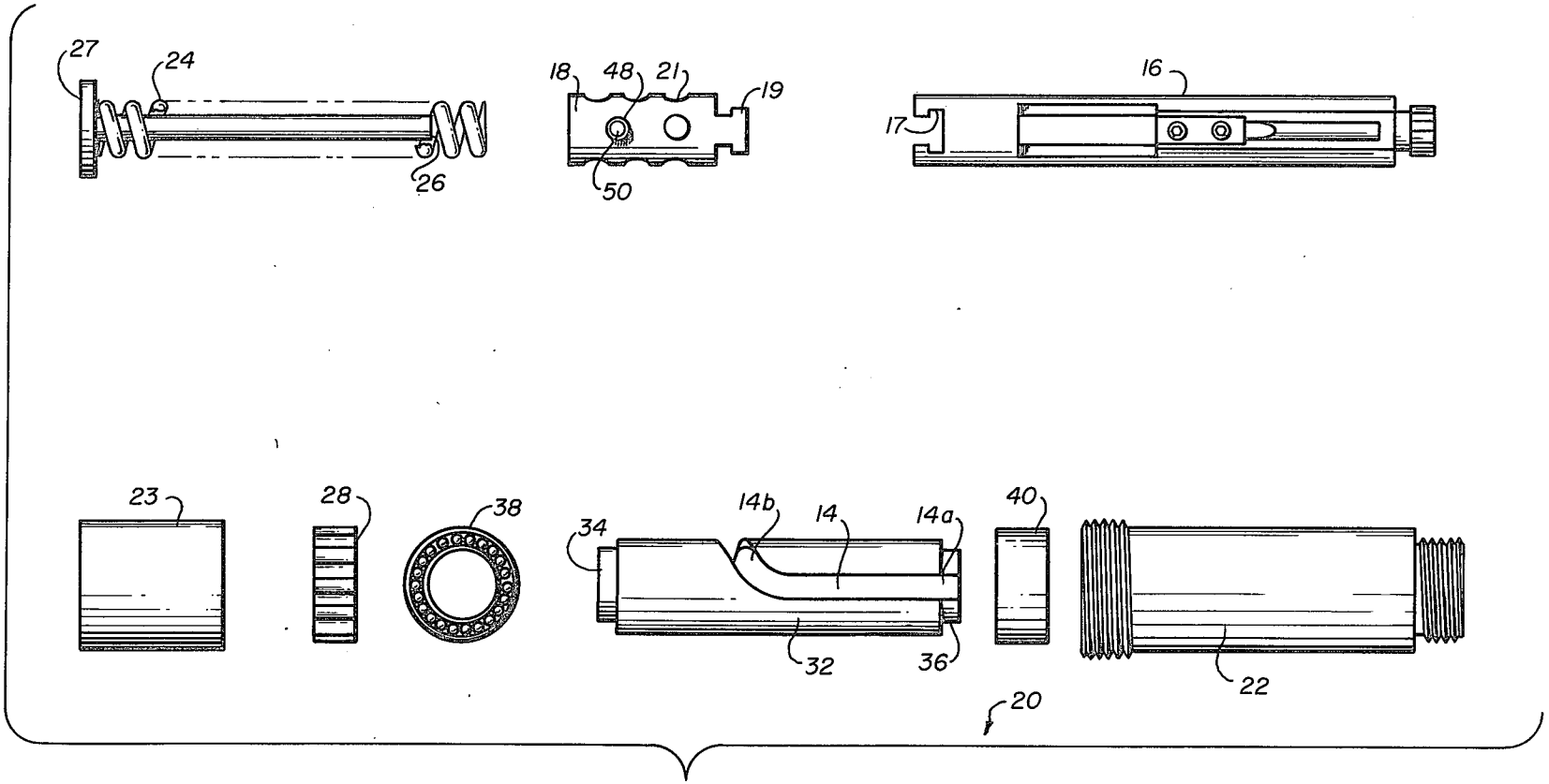
FIG. 4 is an exploded view of the parts of the assembly of FIG. 3.

Referring to FIGS. 1 and 2 there is shown the present invention incorporated in a conventional automatic rifle 2 having a barrel or gun tube 4, a conventional trigger assembly 6, handle or pistol grip 8, magazine receiver 10 and a housing 12 for a conventional generally cylindrically shaped bolt carrier 16 (FIG. 4).

The bolt carrier 16 carries a key 17 mated with a keyway 19 formed in a bolt carriage extension 18 (FIG. 4) which is an axially bored cylinder having a plurality of apertures 21 therein to reduce the weight of the extension. It will be appreciated that the bolt carrier 16 of the conventional rifle assembly could be extended during manufacture to correspond to the combined length of the bolt carrier and bolt carrier extension.

Existing weapons would be modified by utilizing the bolt carrier extension 18.

The rate reducing assembly 20 includes hollow cylindrical rate reducer housing 22 which is threaded into the breech end of the bolt carrier housing 12 (FIG. 1). At its other end, the rate reducer housing 22 threadedly carries an end cap 23.

Figure 3:
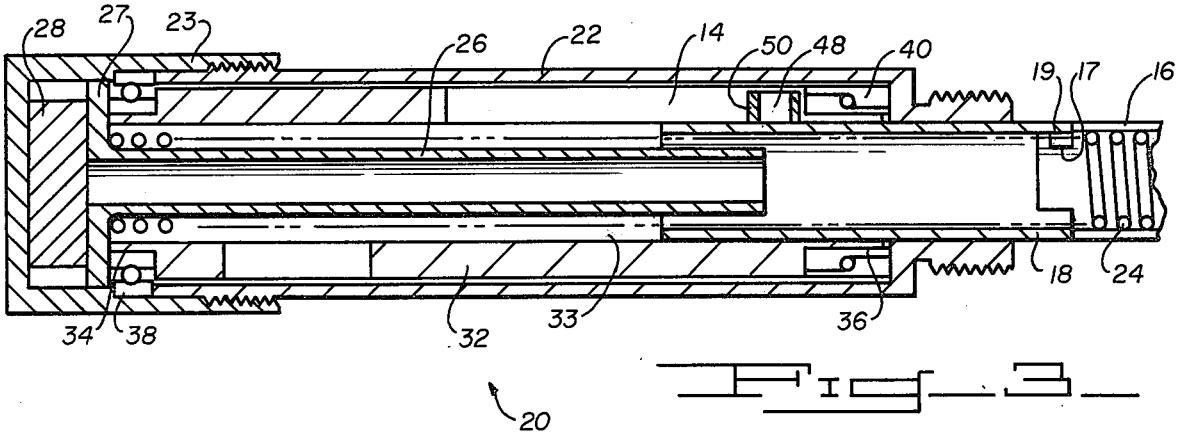
FIG. 3 is a side view in section of the rate reducing assembly.

As seen in FIGS. 3 and 4, the rate reducing assembly 20 thus includes the housing 22, end cap 23, a recoil spring 24, a recoil spring guide 26 having an enlarged circular head 27, a circular buffer means 28, and a rotatable inertia drum 32 having an axial bore 33 and reduced end portions 34 and 36 for drum bearings 38 and 40 to permit rotation of said drum, when assembled.

The inertia drum 32 has a cam groove or raceway 14 communicating the axial bore of the drum with its outer surface (FIG. 4).

The groove 14 has a straight section 14A and a helically formed curved section 14B. The bolt carrier extension 18 is shown (FIG. 4) as carrying a cam follower or roller 48 on a pin 50. Assembly of the rate reducing parts (FIG. 3) is as follows:

The bolt carrier extension 18 is joined to the bolt carrier 16. The housing 22 is threaded to the bolt carrier housing. A pair of end bearings 38 and 40, which are both radial and thrust bearings, are slipped on the reduced end extensions of the inertia drum 32. The bearings and inertia drum are inserted in the housing 22. The three thus assembled parts are connected to the bolt carrier housing by threading. During this process, the bolt carrier extension 18 enters the axial bore 33 of the inertia drum 32. Adjustment is made so that the cam roller 48 enters the cam raceway 14. The recoil spring 24 is inserted in the bore of the inertia drum and bottoms on the interior of the bolt carrier 16. The spring guide 26 is inserted into the spring 24. The length of the spring guide is such that its muzzle oriented end extends partially into the bore of the bolt carrier extension for guide stability purposes. Next the buffer means 28 is inserted in the end cap 23 and the end cap threaded to the end of the rate reducing housing 22 to complete the assembly. During threading of the end cap, the spring 24 is compressed to a predetermined load value and the enlarged head 27 of the spring guide 26, bottom against the buffer means 28, and the end of the bearing 38 to hold the parts in their desired operative positions.

In operation, when the weapon is fired, the trapped gases in the gun mechanism begin to move the bolt carrier rearwardly in its recoil cycle. The moving bolt carrier carries the bolt carrier extension with it and the cam roller 48 moves linearly within the straight section 14A of the cam groove 14 of the inertial drum until the roller enters the curved section 14B of the cam groove. When the roller enters the curved section of the inertia drum, rotary motion of the drum in the bearings is initiated thereby converting or translating the linear force of the gun carrier partially into a rotary force. A portion of the recoil energy thus is stored in the drum and a small portion is dissipated through the housing.

Another portion of the recoil energy of the bolt carrier is stored in spring 24 which is compressed during recoil of the bolt carrier. The head 27 bears against the buffer means 28 whereby still another portion of the energy generated by the recoiling bolt carrier is dissipated. When the bolt carrier comes to the end of its recoil stroke, its motion is temporarily halted. At this moment, the cam roller 48 is near the breech end of the curved section 14B of the cam groove. Preferably the cam grooves length is predetermined so that the cam roller 48 does not contact the end wall of the curved section of the groove to prevent shock forces from being imparted to the inertia drum.

The stored recoil forces in the compressed spring 24 at the end of the recoil movement now exceed the recoil forces and begin to act as a counterrecoil force on the bolt carrier to return the bolt carrier to its in battery position. As the bolt carrier moves in counterrecoil, the cam roller begins to rotate the drum. During its travel back in the curved section 14B of the cam groove, the roller and cam groove act to dissipate stored energy and thus reduce the rate of displacement of the bolt carrier. When, however, the cam roller, during counterrecoil, enters the straight portion of the cam groove, the path of movement of the roller is linear and the rollers velocity corresponds to that of the bolt carrier.

Thus, the present invention employing a rotatable inertia drum having a cam groove with a curved helical groove portion cooperating with a cam roller carried by the recoiling mass provide 5 means to reduce the rate of firing of an automatic weapon.

In tests performed on an M16 automatic rifle modified to incorporate the features of the present invention by forming the keyway on the bolt carriage extension and making a key formed on the bolt carriage and threading of the reducer housing to the breech end of the rifle with a cam groove helix of 16°, the normal cycling rate of the weapon of 1050 rounds per minute was reduced to 540 rounds per minute, thereby greatly enhancing the hit probability and the dispersion of the weapon. Moreover, the present invention enhances ammunition conservation and provides means to control the recoil rate of the weapon. It will be appreciated that it is not necessary for the rate return assembly to be co-axial with the bolt carrier. Modifications could include the assembly being positioned below the bolt carrier so that the bolt carrier and assembly have a common axis in the same vertical plane and the cam follower is on the bottom of the bolt carrier and rides in the cam groove located on top of the drum. Alternatively, the bolt carrier end may carry a ratchet ridable on a gear located on the axis of the drum with the longitudinal axis of the drum being perpendicular to the longitudinal axis of the bolt carrier. In this embodiment, the cam arrangement is not necessary, since the ratchet mechanism performs the drum rotation function.

I claim:

1. In an automatic weapon system having a gun tube with recoil and counterrecoil cycles and a linearly movable bolt carrier, the improvement comprising:

a rotatable drum having a curved cam surface, cam follower means carried by the bolt carrier for tracking in said cam surface of the drum to sequentially rotate the drum in opposite directions and dissipate thereby energy generated by the bolt carrier during recoil and counterrecoil movements of the bolt carrier, and, means for storing recoil energy of the bolt carrier to initiate counterrecoil movement of the bolt carriage, said cam surface including a straight portion adjacent the muzzle end of the weapon system gun tube and a helically curved portion adjacent to the breech end of the system.

2. The system of claim 1 wherein said cam follower means is a cam roller and said cam surface of the drum is a helical groove.

3. The system of claim 2 wherein said storage means is spring means.

4. The system of claim 3 wherein said spring means is concentric with and circumscribes said drum.

5. The system of claim 4 including a spring guide circumscribed by said spring and reciprocally movable within an axial bore of said drum.

6. In an automatic weapon system having a gun tube with recoil and counterrecoil cycles and a linearly reciprocal bolt carrier, the improvement comprising:

a rate reducer housing mounted to said system coaxially with said gun tube and said bolt carrier, a bolt carrier extension carried in said housing for linear movement with said bolt carrier, an inertia drum coaxial with said bolt carrier and rotatably mounted in said housing and circumscribing said bolt carrier extension a peripheral cam groove in the drum having a straight portion communicating with a helically curved portion adjacent to the breech oriented end of the housing and circumscribing a portion of the circumference of the drum, a cam follower roller carried by the bolt carrier extension for riding in the cam groove to rotate the drum and dissipate energy generated by recoil of the bolt carrier, a recoil spring in said housing circumscribing said drum and bottomed at one end against an end shoulder of said bolt carrier extension, a spring guide extending through said spring and having an enlarged end adjacent to the breech end of the housing, an end cap closing the breech end of the housing, and buffer means in said housing in engagement with the enlarged head of said spring guide.

* * * * *